US011147355B2

(12) United States Patent
Chung et al.

(10) Patent No.: US 11,147,355 B2
(45) Date of Patent: Oct. 19, 2021

(54) COSMETIC APPLICATOR

(71) Applicant: CTK COSMETICS CO., LTD., Seongnam-si (KR)

(72) Inventors: In Yong Chung, Seoul (KR); Won Geun Go, Incheon (KR)

(73) Assignee: CTK COSMETICS CO., LTD., Seongnam-si (KR)

( * ) Notice: Subject to any disclaimer, the term of this patent is extended or adjusted under 35 U.S.C. 154(b) by 144 days.

(21) Appl. No.: 16/517,160

(22) Filed: Jul. 19, 2019

(65) Prior Publication Data

US 2020/0337433 A1 Oct. 29, 2020

Related U.S. Application Data

(63) Continuation of application No. 16/421,732, filed on May 24, 2019, now abandoned.

(30) Foreign Application Priority Data

Apr. 25, 2019 (KR) ..... 10-2019-0048139

(51) Int. Cl.
*A45D 34/04* (2006.01)
*A45D 40/20* (2006.01)
*A45D 40/30* (2006.01)

(52) U.S. Cl.
CPC ..... *A45D 34/04* (2013.01); *A45D 40/20* (2013.01); *A45D 40/30* (2013.01); *A45D 2200/1072* (2013.01)

(58) Field of Classification Search
CPC ..... A45D 40/20; A45D 40/30; A45D 34/042; A45D 34/041; A45D 34/04; A45D 2200/1072; A45D 2040/201; A45D 2034/002; A45D 44/12
USPC ..... 132/216, 218, 319, 200; D28/7
See application file for complete search history.

(56) References Cited

U.S. PATENT DOCUMENTS 1,974,825 A * 9/1934 Lovie ..... A45D 40/30 132/216
4,165,755 A * 8/1979 Cassai ..... A45D 40/265 132/218
5,178,170 A * 1/1993 Kassai ..... A45D 40/18 132/216
5,957,142 A * 9/1999 Karafilis ..... A45D 40/26 132/216
6,305,389 B1 * 10/2001 Bakken ..... A45D 44/12 132/216
6,961,977 B2 * 11/2005 Seidler ..... A45D 33/20 132/293
7,478,958 B2 * 1/2009 Ramet ..... A45D 40/26 401/123

(Continued)

FOREIGN PATENT DOCUMENTS

GB 376675 A * 7/1932 ..... A45D 40/30

*Primary Examiner* — Tatiana L Nobrega
*Assistant Examiner* — Sarah Woodhouse
(74) *Attorney, Agent, or Firm* — Novick, Kim & Lee, PLLC; Jae Youn Kim; Jihun Kim

(57) ABSTRACT

An embodiment of this invention provides a cosmetic applicator including a drawing unit containing and applying a cosmetic and a cap unit being configured to be detachably coupled to the drawing unit. The cap unit includes a geometry module and is configured to guide the drawing unit during an eye makeup.

12 Claims, 10 Drawing Sheets

(56) References Cited

U.S. PATENT DOCUMENTS

| | | | | |
|---|---|---|---|---|
| 2004/0107975 | A1* | 6/2004 | Bender | A45D 40/30<br>132/319 |
| 2006/0225761 | A1* | 10/2006 | Secosky | A45D 40/18<br>132/218 |
| 2009/0183747 | A1* | 7/2009 | Salicunaj | A45D 40/30<br>132/200 |
| 2016/0286936 | A1 | 10/2016 | Ashburn | |
| 2017/0049216 | A1* | 2/2017 | Rhoades | A45D 40/30 |
| 2017/0303665 | A1* | 10/2017 | Ashburn | A45D 34/042 |
| 2018/0092452 | A1* | 4/2018 | Chun | A45D 40/02 |
| 2019/0239622 | A1* | 8/2019 | Silverberg | A45D 34/045 |
| 2020/0069031 | A1* | 3/2020 | Gabon | A45D 40/262 |

* cited by examiner

COSMETIC APPLICATOR

CROSS-REFERENCE TO RELATED APPLICATIONS

This application is a Continuation application of U.S. application Ser. No. 16/421,732 filed on May 24, 2019 and the entire contents of these prior-filed applications are hereby incorporated by reference.

BACKGROUND OF THE INVENTION

Field of the Invention

The present invention relates to a cosmetic applicator, more specifically, to a cosmetic applicator that is used to guide a cosmetic around an eye.

Description of the Related Art

A cosmetic applicator may be used as a cosmetic of an eye makeup. The cosmetic applicator may mean eyeliner, for example. The cosmetic applicator may be used to apply a cosmetic around an eye. Types of cosmetic applicators include a liquid type, a brush type, a pencil type, and the like.

Facial bones around the eye may include both of a recessed portion and a protruding portion. An eyelid may be supported by a pupil while forming a curvature. Hence, it may not be easy to put on the eye makeup.

In particular, a wing eye makeup may be put on by a highly-skilled makeup artist. Hence, there may be a demand for development of a cosmetic applicator having a function with which the eye makeup can be easily put on.

CITATION LIST

Patent Literature

Patent Literature 1: US 20160286936 A1

SUMMARY OF THE INVENTION

A technical object to be achieved by this invention is to provide a cosmetic applicator including a geometry portion that is configured to guide an eye makeup.

Another technical object of this invention is to provide a cosmetic applicator in which a plurality of geometry portion are selectively coupled to a second body.

Technical objects to be achieved by this invention are not limited to the technical objects mentioned above, and the following description enables other unmentioned technical objects to be clearly understood by people having normal knowledge in the art to which this invention belongs.

According to an aspect of this invention, this invention provides a cosmetic applicator, including: a drawing unit including a first body, containing a cosmetic and a tip, being extended from the first body, applying the cosmetic on a face; and a cap unit, being configured to be detachably coupled to the drawing unit, the cap unit including a second body, being detachably coupled to the drawing unit, wherein the second body accommodates the tip when the cap unit is coupled to the drawing unit; and a geometry module, being connected to the second body, being configured to guide the tip on the face around an eye. The second body includes a first coupling portion being coupled to the geometry module. The geometry module includes a second coupling portion, being positioned on a side of the geometry module, being coupled to the first coupling portion and a geometry portion, being positioned at another side of the geometry module, including a curved line portion having a curvature.

DETAILED DESCRIPTION OF THE PREFERRED EMBODIMENTS

Hereinafter, this invention will be described with reference to the accompanying drawings. However, this invention can be realized as various different embodiments and, thus, is not limited to embodiments described here. A part unrelated to the description is omitted from the drawings in order to clearly describe this invention, and similar reference signs are assigned to similar parts through the entire specification.

In the entire specification, when a certain part is "connected to (accessed to, in contact with, or coupled to)" another part, this includes not only a case where the parts are "directly connected" to each other but also a case where the parts are "indirectly connected" to each other with another member interposed therebetween. In addition, when a certain part "includes" a certain configurational element, this means that another configurational element is not excluded but the configurational element can be further included unless specifically described otherwise.

Terms used in this specification are only used to describe a specific embodiment and are not intentionally used to limit this invention. A singular form includes a plural form unless obviously implied otherwise in context. In this specification, terms such as "to include" or "to have" are construed to specify that a feature, a number, a stage, an operation, a configurational element, a part, or an assembly thereof described in the specification is present and not to exclude presence or a possibility of addition of one or more other features, numbers, stages, operations, configurational elements, parts, or assemblies thereof in advance.

Hereinafter, an embodiment of this invention will be described in detail with reference to the accompanying drawings.

Figure 1:
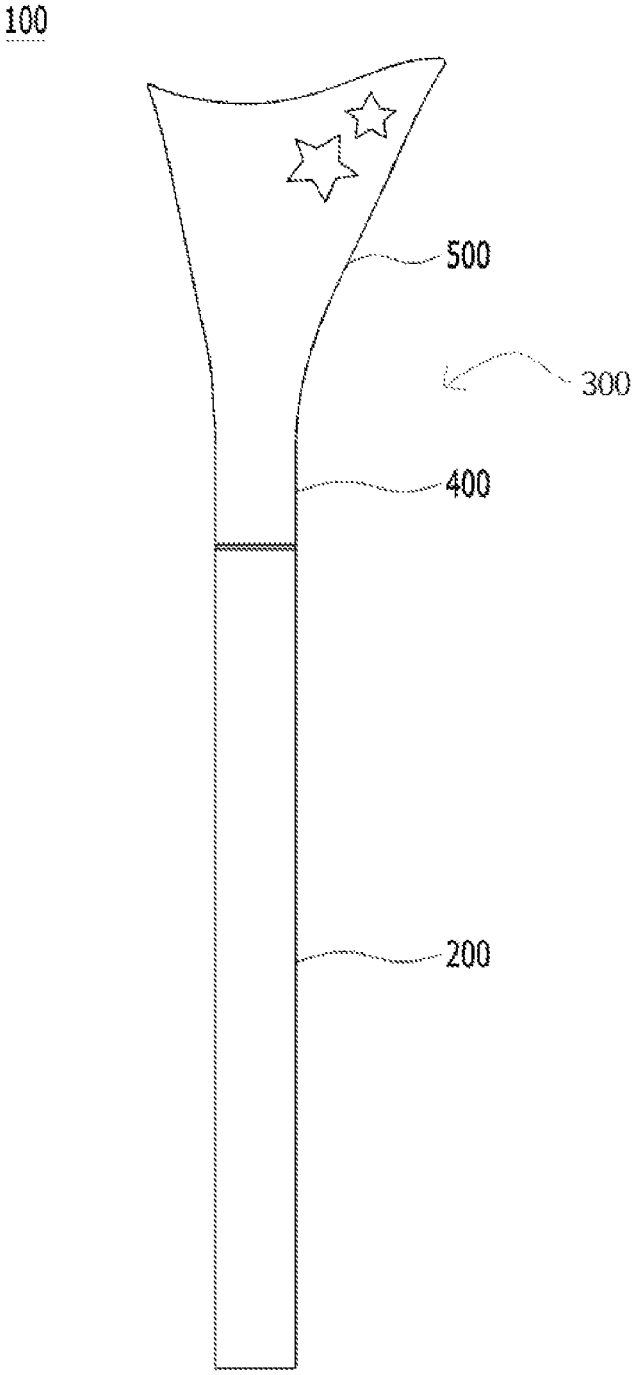
FIG. 1 is a view illustrating a cosmetic applicator according to an embodiment of this invention.

FIG. 1 is a view illustrating a cosmetic applicator 100 according to an embodiment of this invention. The cosmetic applicator 100 may be used as a cosmetic around an eye on a face. For example, the cosmetic applicator 100 is used to apply a cosmetic on an eyelid. Hence, the cosmetic applicator 100 can be referred to as "eyeliner". As another example, the cosmetic applicator 100 is used to apply a cosmetic on an eyebrow.

With reference to FIG. 1, the cosmetic applicator 100 is configured to include a drawing unit 200 and a cap unit 300. The drawing unit 200 is configured to be coupled to the cap unit 300. The drawing unit 200 is configured to form a shape elongated in a length direction. The length direction of the drawing unit 200 is parallel to a direction from the drawing unit 200 toward the cap unit 300.

The cap unit 300 is configured to be coupled to at least a part of the drawing unit 200. The cap unit 300 is configured to be separated from the drawing unit 200. For example, a user can put on a makeup by using the drawing unit 200 after separating the cap unit 300 from the drawing unit 200. For example, the user can couple the cap unit 300 to the drawing unit 200 after finishing the makeup by using the drawing unit 200.

The cap unit 300 is configured to include a second body 400. The second body 400 is configured to be coupled to the drawing unit 200. The second body 400 is configured to be separated from the drawing unit 200. The second body 400 is configured to be formed in a length direction. The length direction of the second body 400 can be parallel to the length direction of the drawing unit 200. For example, the second body 400 is configured to form a shape elongated in the length direction of the drawing unit 200.

The cap unit 300 is configured to include a geometry module 500. The geometry module 500 is configured to be connected to the second body 400. For example, the geometry module 500 is configured to form a shape extended from the second body 400. The geometry module 500 is configured to be positioned at an opposite side of the drawing unit 200 with respect to the second body 400. In other words, the second body 400 is configured to be positioned between the geometry module 500 and the drawing unit 200.

The geometry module 500 is configured to have various shapes. The user can draw eye lines in various shapes around an eye by using the geometry module 500.

Figure 2:
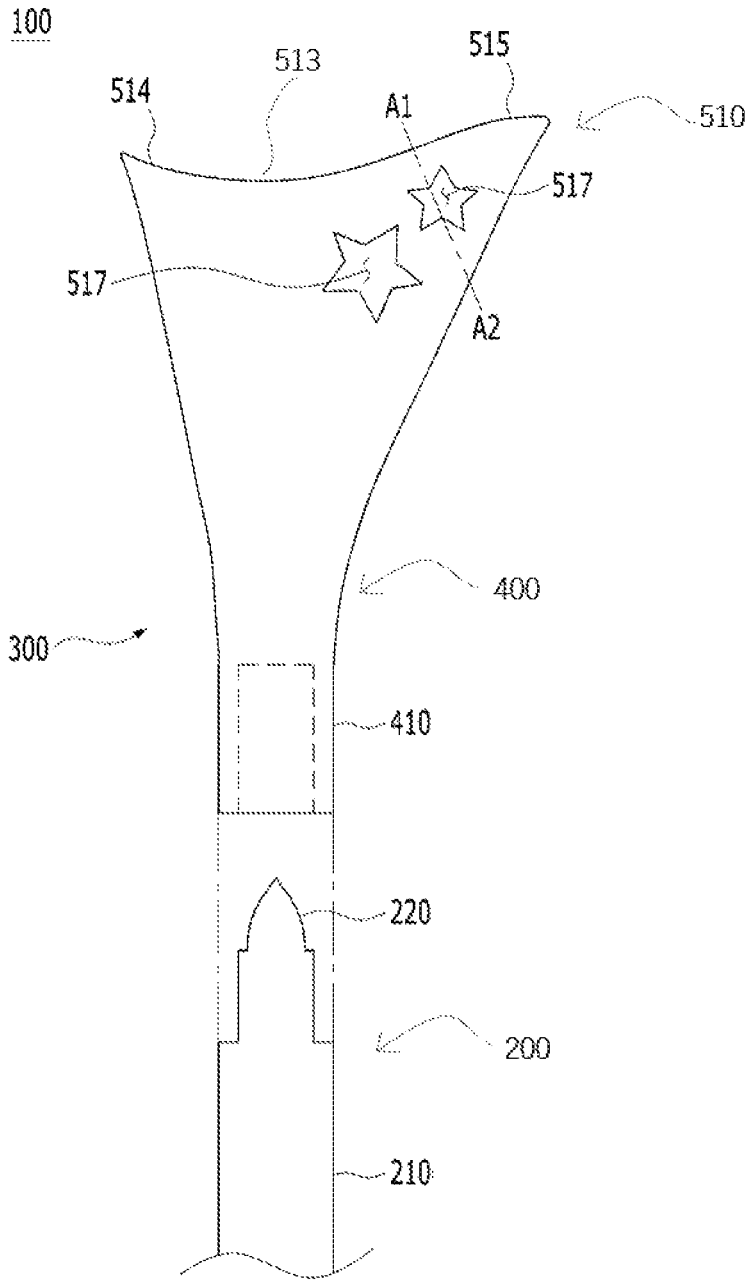
FIG. 2 is an exploded view of the cosmetic applicator illustrated in FIG. 1.

FIG. 2 is an exploded view of the cosmetic applicator illustrated in FIG. 1.

With reference to FIG. 2, the drawing unit 200 is configured to include a first body 210. The first body 210 is configured to have a shape elongated in the length direction of the drawing unit 200. The first body 210 is configured to be a part of the cosmetic applicator 100 being gripped by the user during use of the cosmetic applicator 100. The first body 210 is configured to contain a cosmetic.

The drawing unit 200 is configured to include a tip 220. The tip 220 is configured to be connected or coupled to the first body 210. The tip 220 is configured to have a shape extended from the first body 210 in the length direction.

The tip 220 is configured to contain a cosmetic. For example, the tip 220 is configured to be supplied with the cosmetic from the first body 210. For example, the tip 220 is configured to contain a liquid cosmetic. For example, the tip 220 is configured to contain a solid cosmetic. That is, the tip 220 is configured to contain a pencil-type cosmetic. For example, the tip 220 is configured to have a shape of a brush. The tip 220 is configured to supply a cosmetic to a position around the user's eye.

The second body 400 is configured to include an accommodation portion 410. The accommodation portion 410 is configured to be coupled to or separated from the drawing unit 200. The accommodation portion 410 is configured to form a hollow portion. The hollow portion formed in the accommodation portion 410 is configured to have a shape recessed from an end toward another end of the second body 400. For example, the hollow portion formed in the accommodation portion 410 is configured to be opened toward the drawing unit 200.

When the second body 400 is coupled to the drawing unit 200, the accommodation portion 410 can accommodate the tip 220. When the second body 400 is separated from the drawing unit 200, the tip 220 can be separated from the accommodation portion 410 and exposed to an outside of the accommodation portion.

The accommodation portion 410 is configured to be detachably coupled to the drawing unit 200. For example, the accommodation portion 410 and the drawing unit 200 may form a structure in which the accommodation portion and the drawing unit are detachably coupled to each other. For example, the structure formed in the accommodation portion 410 and the drawing unit 200 can be an undercut type of fastening structure.

The geometry module 500 is configured to include a geometry portion 510. The geometry portion 510 is configured to have a shape extended from the second body 400. The geometry portion 510 is configured to be positioned on the other end of the second body 400. The geometry portion 510 is configured to form a shape of a plate as a whole.

The geometry portion 510 is configured to have various shapes. The geometry portion 510 is configured to include a curved line portion 513. A plurality of curved line portions 513 can be provided. The curved line portion 513 is configured to have a curvature. When the curvature of the curved line portion 513 is zero, the curved line portion 513 may mean a straight line.

The curved line portion 513 is configured to include a concave portion 514. The concave portion 514 is configured to be concave toward an outside of the curved line portion. The curved line portion 513 is configured to include a convex portion 515. The convex portion 515 is configured to be convex toward the outside of the curved line portion. The convex portion 515 is configured to be extended from the concave portion 514. The convex portion 515 is configured to be connected to the concave portion 514. An inflection point can be formed on a boundary between the concave portion 514 and the convex portion 515.

The geometry portion 510 is configured to include an opening 517. The opening 517 is configured to have various shapes. For example, the opening 517 is configured to form a shape of a star. A plurality of openings 517 can be provided.

Figure 3:
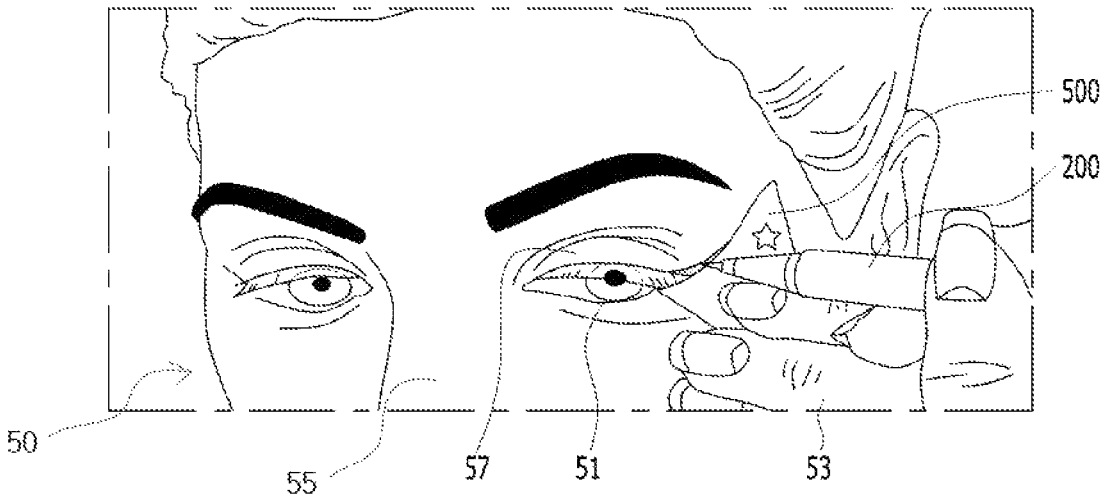
FIG. 3 is a view illustrating a state in which the cosmetic applicator illustrated in FIG. 2 is used.

FIG. 3 is a view illustrating a state in which the cosmetic applicator 100 illustrated in FIG. 2 is used.

With reference to FIG. 3, a user 50 can have a face 55 and a hand 53. The face 55 can include an eye 51 and an eyelid 57. The user 50 can hold the drawing unit 200. The user 50 can position the geometry module 500 around the eye 51. For example, the user 50 can position the geometry module 500 on the eyelid 57.

The geometry module 500 is configured to guide the drawing unit 200. In other words, the drawing unit 200 is configured to be guided along an edge of the geometry module 500. Accordingly, the cosmetic contained in the drawing unit 200 can be applied around the eye 51 along the geometry module 500. For example, the cosmetic contained in the drawing unit 200 can be applied on the eyelid 57 along the geometry module 500. As a result, the shape of the cosmetic applied around the eye 51 can correspond to the shape of the geometry module 500.

Figure 4:
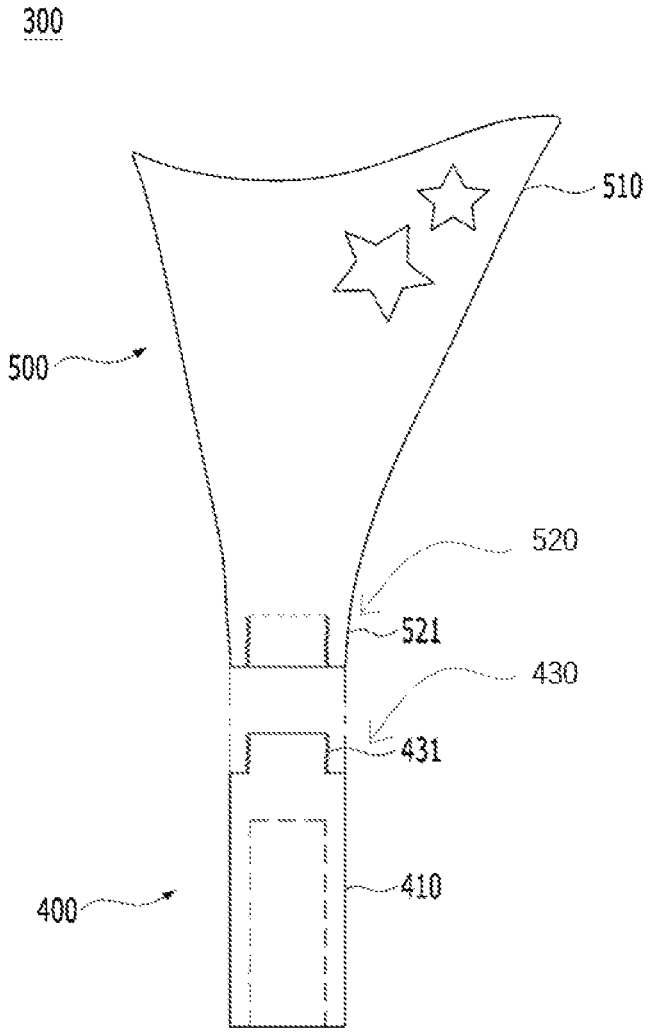
FIG. 4 is a view illustrating a cap unit according to a first embodiment.

FIG. 4 is a view illustrating the cap unit 300 according to a first embodiment.

With reference to FIG. 4, the cap unit 300 is configured to include the second body 400 and the geometry module 500. The geometry module 500 is configured to be coupled to or separated from the second body 400. The second body 400 is configured to include a first coupling portion 430. The first coupling portion 430 is configured to be positioned at the other end of the second body 400.

The first coupling portion 430 is configured to be fitted into a second coupling portion 520. Alternatively, the second coupling portion 520 is configured to be fitted into the first coupling portion 430. As another example, the first coupling portion 430 is configured to include a first screw coupling portion 431. The first screw coupling portion 431 is configured to form threads.

The geometry module 500 is configured to include the geometry portion 510 and the second coupling portion 520. The second coupling portion 520 is configured to be positioned on a side of the geometry module 500. The geometry portion 510 is configured to be positioned at another side of the geometry module 500. The geometry portion 510 is configured to be connected to the second coupling portion 520. The geometry portion 510 and the second coupling portion 520 are configured to be integrally formed.

The second coupling portion 520 is configured to be detachably coupled to the first coupling portion 430. That is, the second coupling portion 520 is configured to be coupled to or separated from the first coupling portion 430. The second coupling portion 520 and the first coupling portion 430 may form a structure in which the coupling portions are detachably coupled to each other.

For example, the second coupling portion 520 is configured to include a second screw coupling portion 521. The second screw coupling portion 521 is configured to form threads. The threads formed at the second screw coupling portion 521 are configured to correspond to the threads formed at the first screw coupling portion 431.

As another example, a structure formed in the second coupling portion 520 and the first coupling portion 430 can be an undercut type of fastening structure. For example, the second coupling portion 520 is configured to include a groove on an inner side thereof, and the first coupling portion 430 is configured to include a protrusion. The protrusion of the first coupling portion 430 is configured to correspond to the groove of the second coupling portion 520. Alternatively, the second coupling portion 520 is configured to include the protrusion on the inner side thereof, and the first coupling portion 430 is configured to include the groove. The protrusion of the second coupling portion 520 is configured to correspond to the groove of the first coupling portion 430.

In FIG. 4, the first coupling portion 430 has a protruding shape, and the second coupling portion 520 has a concave shape. However, this invention is not limited thereto. For example, the first coupling portion 430 may be configured to have the concave shape, and the second coupling portion 520 may be configured to have a convex shape. The coupling portion (430 or 520) may mean at least one of the first coupling portion 430 and the second coupling portion 520. The "concave coupling portion" may mean the coupling portion (430 or 520) having the concave shape among the first coupling portion 430 and the second coupling portion 520. The "convex coupling portion" may mean the coupling portion (430 or 520) having the convex shape among the first coupling portion 430 and the second coupling portion 520. The convex coupling portion is configured to be inserted into the concave coupling portion.

Figure 5:
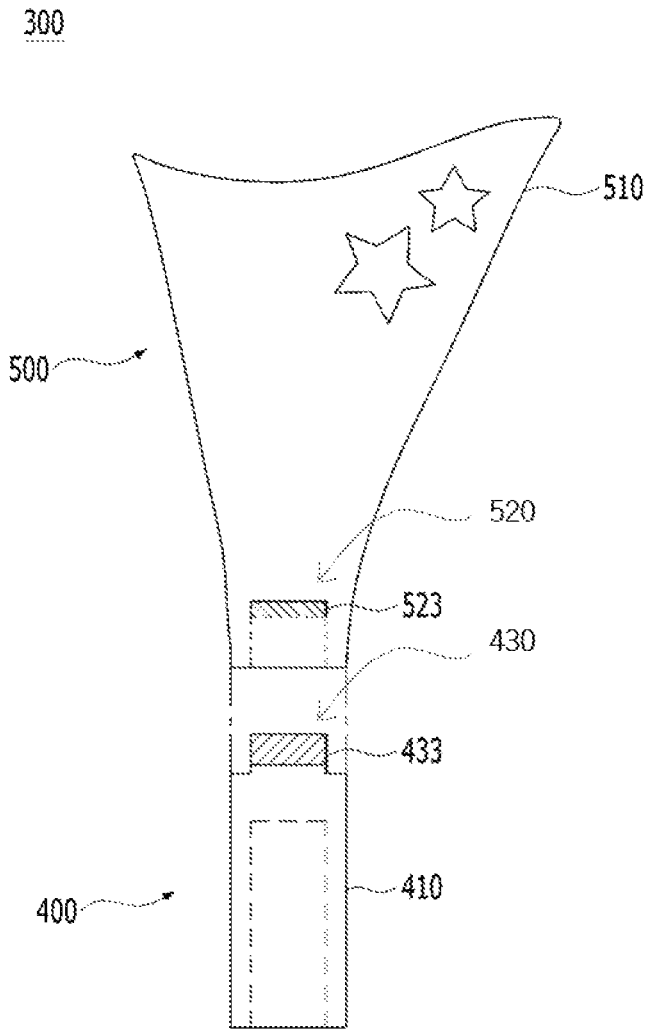
FIG. 5 is a view illustrating a cap unit according to a second embodiment of this invention.

FIG. 5 is a view illustrating the cap unit 300 according to a second embodiment of this invention.

With reference to FIG. 5, the first coupling portion 430 is configured to include a first magnetic coupling portion 433. The second coupling portion 520 is configured to include a second magnetic coupling portion 523. The second magnetic coupling portion 523 is configured to be magnetically coupled to the first magnetic coupling portion 433.

At least one of the first magnetic coupling portion 433 and the second magnetic coupling portion 523 is configured to contain a magnetic material. For example, at least one of the first magnetic coupling portion 433 and the second magnetic coupling portion 523 is configured to contain a ferromagnetic material. For example, at least one of the first magnetic coupling portion 433 and the second magnetic coupling portion 523 is configured to contain a permanent magnet.

Figure 6:
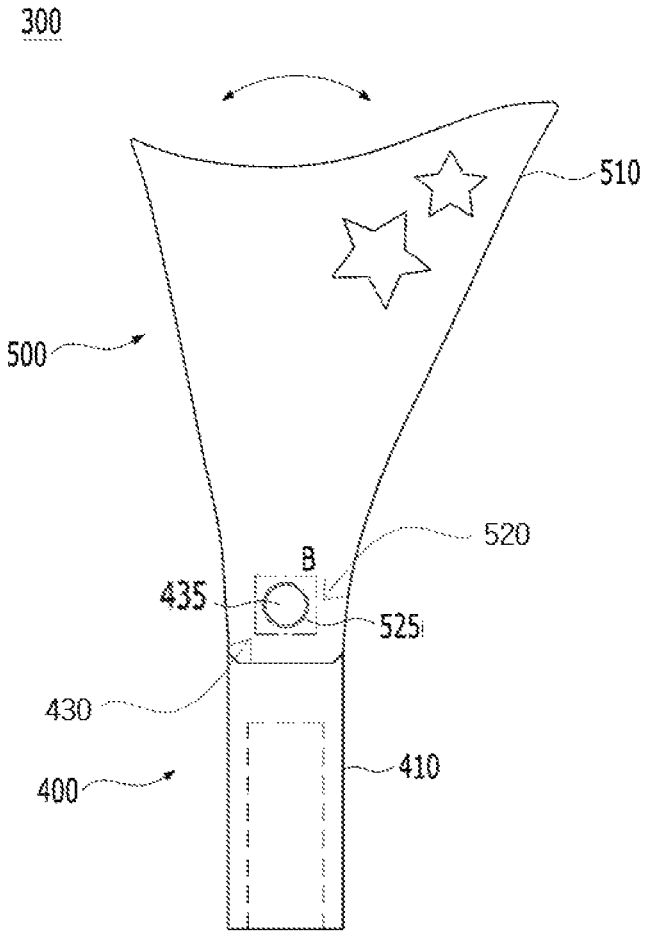
FIG. 6 is a view illustrating a cap unit according to a third embodiment of this invention.

FIG. 6 is a view illustrating the cap unit 300 according to a third embodiment of this invention.

With reference to FIG. 6, the first coupling portion 430 is configured to include a first hinge coupling portion 435. The first hinge coupling portion 435 is configured to provide a rotation shaft to the geometry module 500. The second coupling portion 520 is configured to include a second hinge coupling portion 525. The second hinge coupling portion 525 is configured to be coupled to the first hinge coupling portion 435.

The geometry module 500 is configured to rotate around the first hinge coupling portion 435. For example, the geometry module 500 is configured to rotate around the first hinge coupling portion 435 in a direction of a bidirectional arrow illustrated in FIG. 6.

Relative positions of the geometry module 500 and the second body 400 can change as the geometry module 500 rotates. For example, as illustrated in FIG. 6, the geometry portion 510 is configured to be positioned at an opposite side of the accommodation portion 410 with respect to the first hinge coupling portion 435. As another example, the geometry portion 510 is configured to be overlapped with the accommodation portion 410.

Figure 7:
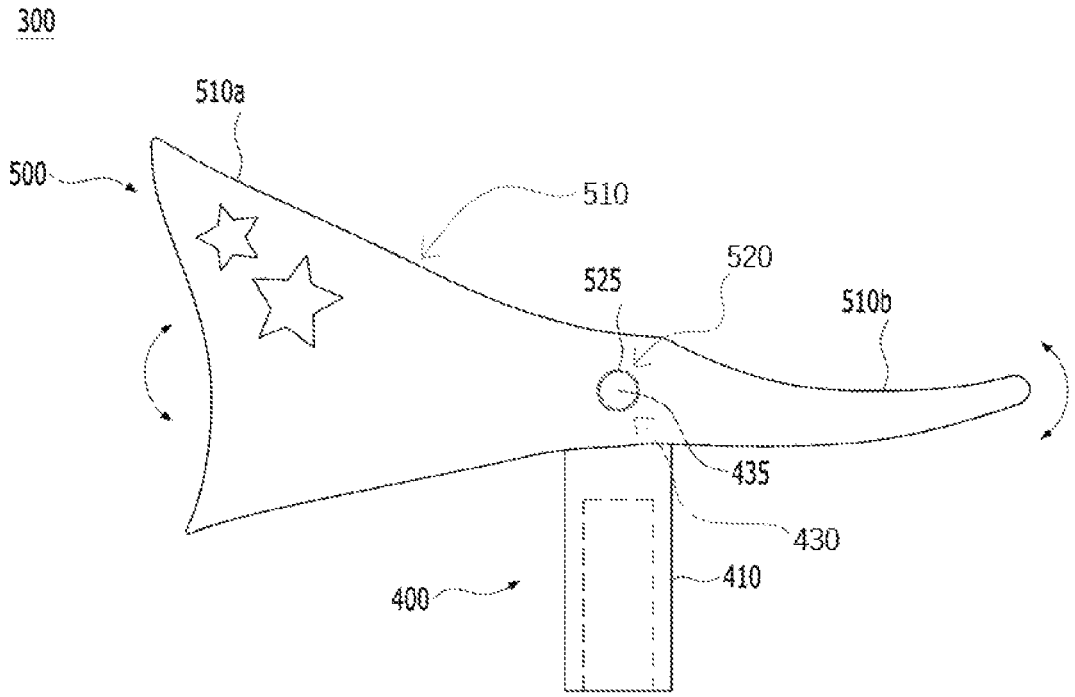
FIG. 7 is a view illustrating a cap unit according to a fourth embodiment of this invention.

FIG. 7 is a view illustrating the cap unit 300 according to a fourth embodiment of this invention.

With reference to FIG. 7, a plurality of geometry portion 510 can be provided. For example, the geometry portion 510 is configured to include a first geometry portion 510*a* and a second geometry portion 510*b*. The second coupling portion 520 is configured to be positioned between the first geometry portion 510*a* and the second geometry portion 510*b*. The second coupling portion 520 is configured to include the second hinge coupling portion 525. The first geometry portion 510*a* and the second geometry portion 510*b* is configured to have a shape extended from the second coupling portion 520.

The geometry portion 510 is configured to rotate around the first hinge coupling portion 435. For example, the geometry portion 510 is configured to rotate around the first hinge coupling portion 435 in a direction of a bidirectional arrow illustrated in FIG. 7.

Relative positions of the geometry portion 510 to the second body 400 can change as the geometry portion 510 rotates. For example, the first geometry portion 510*a* is configured to be overlapped with the second body 400, and the second geometry portion 510*b* is configured to be positioned at an opposite side of the first geometry portion 510*a*. In this case, the second geometry portion 510*b* can be easily used by the user. As another example, the second geometry portion 510*b* is configured to be overlapped with the second body 400, and the first geometry portion 510*a* is configured to be positioned at an opposite side of the second geometry portion 510*b*. In this case, the first geometry portion 510*a* can be easily used by the user.

Figure 8:
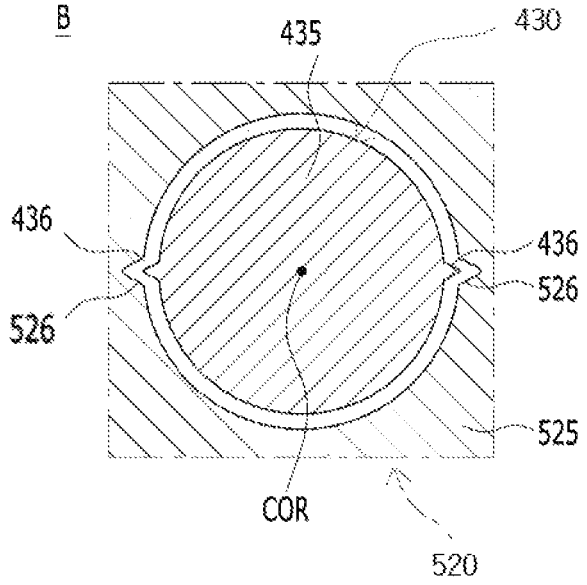
FIG. 8 illustrates a cross section of B in FIG. 6.

FIG. 8 illustrates a cross section of B in FIG. 6.

With reference to FIG. 8, a shape of the second coupling portion 520 is configured to correspond to a shape of the first coupling portion 430. For example, the second coupling portion 520 is configured to include a hollow portion inside, and an outer peripheral surface of the first coupling portion 430 is configured to correspond to an inner peripheral surface of the second coupling portion 520.

The second coupling portion 520 is configured to be coupled to the first coupling portion 430. For example, the second hinge coupling portion 525 is configured to be coupled to the first hinge coupling portion 435. The second hinge coupling portion 525 is configured to rotate around the center of rotation (COR).

The first coupling portion 430 is configured to include a first stopper 436. The first stopper 436 is configured to be coupled to the first hinge coupling portion 435. For example, the first stopper 436 is configured to be integrally formed at the first hinge coupling portion 435. For example, the first stopper 436 is configured to project from the first hinge coupling portion 435. The first stopper 436 is configured to be coupled to the second coupling portion 520.

The second coupling portion 520 is configured to include a second stopper 526. The second stopper 526 is configured to be connected to the second hinge coupling portion 525. For example, the second stopper 526 is configured to be integrally formed at the second hinge coupling portion 525. For example, the second stopper 526 is configured to be recessed in the second hinge coupling portion 525. A shape of the second stopper 526 is configured to correspond to a shape of the first stopper 436. The second stopper 526 is configured to be coupled to the first stopper 436.

The first stopper 436 and the second stopper 526 are configured to limit the rotation of the second hinge coupling portion 525 with respect to the first hinge coupling portion 435. For example, when an external force equal to or smaller than a preset force (hereinafter, a "first force") is applied to the cap unit 300 (refer to FIG. 6), the first stopper 436 and the second stopper 526 can prohibit the rotation of the second hinge coupling portion 525 with respect to the first hinge coupling portion 435. For example, when an external force greater than the first force is applied to the cap unit 300 (refer to FIG. 6), it is possible to prohibit the rotation of the second hinge coupling portion 525 with respect to the first hinge coupling portion 435.

In FIG. 8, the first stopper 436 has a protruding shape, and the second stopper 526 has a recessed shape. However, this invention is not limited thereto. For example, the first stopper 426 may be configured to have the recessed shape, and the second stopper 526 may be configured to have the protruding shape.

At least one of the first stopper 436 and the second stopper 526 is configured to have elasticity. For example, the first stopper 436 is configured to have elasticity with respect to the first hinge coupling portion 435. For example, the second stopper 526 is configured to have elasticity with respect to the second hinge coupling portion 525.

At least one of the first stopper 436 and the second stopper 526 can be provided in plurality. For example, a plurality of first stoppers 436 can be provided. For example, a plurality of second stoppers 526 can be provided.

For example, the plurality of second stoppers 526 having a recessed shape can be provided. The number of first stoppers 436 having the protruding shape is equal to or smaller than the number of second stoppers 526 having the recessed shape. The stopper (436 or 526) may be at least one of the first stopper 436 and the second stopper 526.

With reference to FIGS. 4 to 8, it is possible to describe a function of the cap unit 300 from a viewpoint of a user who uses the cap unit 300.

With reference to FIGS. 4 and 5, a plurality of geometry modules 500 are provided. The user can select one out of the plurality of geometry modules 500 as preferred and can couple the selected geometry module to the second body 400. The user can use the geometry module 500 after separating the second body 400 from the drawing unit 200.

For example, with reference to FIG. 4, the user can select one out of the plurality of geometry modules 500 as preferred and couple the selected geometry module to the second body 400, depending on a structure of the first coupling portion 430 and the second coupling portion 520 to which a fitting method or a screw coupling method is applied.

For example, with reference to FIG. 5, the user can select one out of the plurality of geometry modules 500 as preferred and couple the selected geometry module to the second body 400, depending on a structure of the first coupling portion 430 and the second coupling portion 520 to which a magnetic coupling method is applied. In this case, the geometry module 500 is configured to be relatively easily coupled to or separated from the second body 400.

With reference to FIGS. 6 to 8, the user rotates the geometry module 500 with respect to the second body 400, and thereby it is possible to use the geometry module 500 for a makeup.

For example, with reference to FIG. 6, the user can rotate the geometry module 500 with respect to the second body 400. The user can overlap the geometry portion 510 with the second body 400 when the cosmetic applicator 100 (refer to FIG. 1) is not used. The user can rotate the geometry portion 510 from the second body 400 and use the geometry portion 510 when the cosmetic applicator 100 (refer to FIG. 1) is used. Hence, it is possible to increase space efficiency of the cosmetic applicator 100 (refer to FIG. 1).

For example, with reference to FIG. 7, the user can select one of the first geometry portion 510*a* and the second geometry portion 510*b* and use the selected geometry portion for makeup. For example, when the first geometry portion 510*a* is used for makeup, the second geometry portion 510*b* is configured to be adjacent to or overlapped with the second body 400. For example, when the second geometry portion 510*b* is used for makeup, the first geometry portion 510*a* is configured to be adjacent to or overlapped with the second body 400. In FIG. 7, the geometry portion 510 includes the first geometry portion 510*a* and the second geometry portion 510*b*; however, the range of this invention is not limited thereto. For example, three or more geometry portion 510 can be provided.

For example, with reference to FIG. 8, the user can rotate the geometry portion 510 with respect to the second body 400. The stopper (436 or 526) is configured to set a relative position of the geometry portion 510 to the second body 400.

Figure 9:
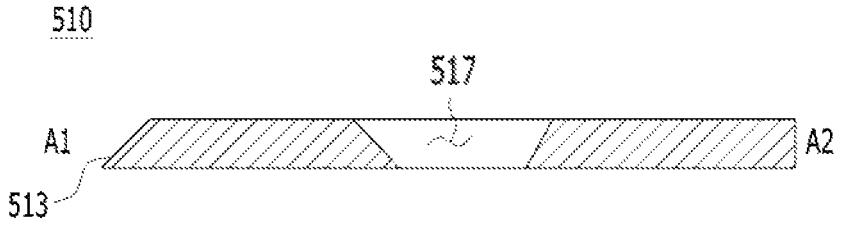
FIG. 9 is a view illustrating a cross section taken along A1-A2 in a geometry portion illustrated in FIG. 2.

FIG. 9 is a view illustrating a cross section taken along A1-A2 in the geometry portion 510 illustrated in FIG. 2.

With reference to FIG. 9, it is possible to observe a thickness of the geometry portion 510. The thickness of the geometry portion 510 can change depending on a position. The geometry portion 510 is configured to be reduced in thickness as it goes toward the curved line portion 513 or the opening 517. The curved line portion 513 or the opening 517 is configured to form a part of an edge or a boundary of the geometry portion 510. That is, the geometry portion 510 is configured to be reduced in thickness as it does toward at least a part of the boundary of the geometry portion 510. For example, a part of the geometry portion 510 adjacent to A2 of the edge is configured to have a thickness greater than that of the edge of the curved line portion 513.

When the tip 220 (refer to FIG. 2) of the cosmetic applicator 100 (refer to FIG. 2) is applied to the eye 51 (refer to FIG. 3) of the user 50 (refer to FIG. 3), the geometry portion 510 is configured to cover a part of skin around the eye 51 (refer to FIG. 3) from the tip 220 (refer to FIG. 2). Alternatively, the tip 220 (refer to FIG. 2) is configured to be guided along the geometry portion 510. The tip 220 (refer to FIG. 2) is configured to easily apply the cosmetic around the eye 51 (refer to FIG. 3) of the user 50 (refer to FIG. 3) along the shape of the geometry portion 510 in accordance with a thickness profile of the geometry portion 510 illustrated in FIG. 9.

Figure 10A:
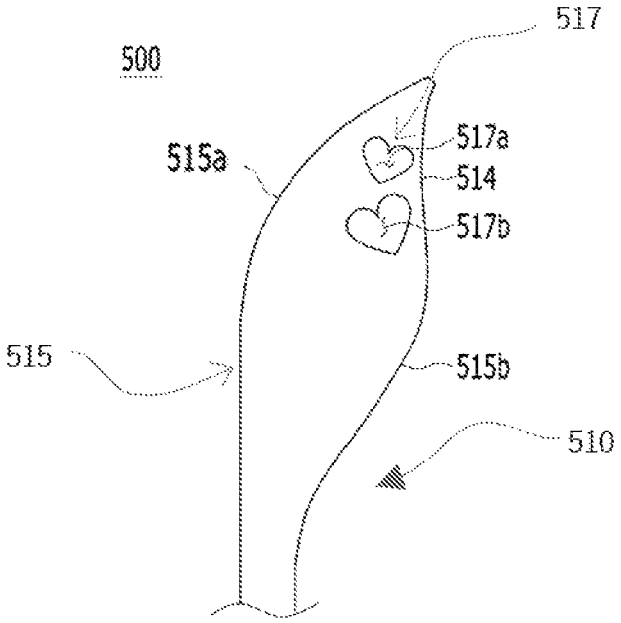
FIGS. 10(*a*) and 10(*b*) are views illustrating shapes of the geometry portion according to several embodiments.
Figure 10B:
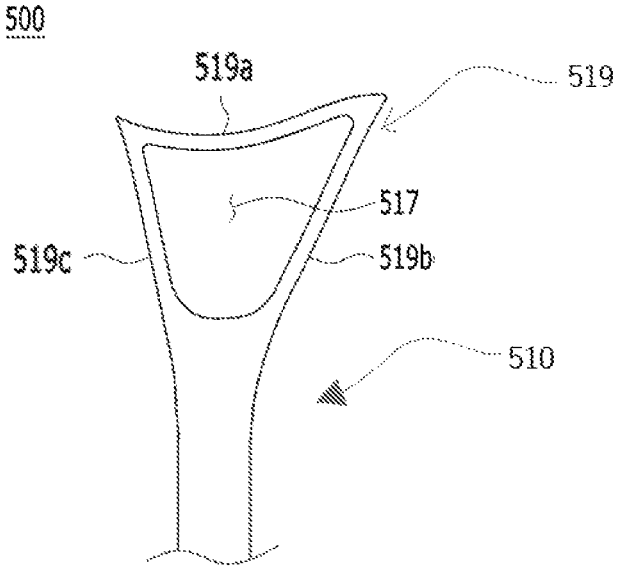

FIGS. 10(*a*) and 10(*b*) are views illustrating the shapes of the geometry portion 510 according to several embodiments.

With reference to FIG. 10(*a*), a plurality of convex portions 515 are configured to be provided. For example, the convex portion 515 is configured to include a first convex portion 515*a* and a second convex portion 515*b*. The first convex portion 515*a* is configured to be separated from the second convex portion 515*b*. A curvature of the first convex portion 515*a* can be different from a curvature of the second convex portion 515*b*. It is possible to determine the use of the first convex portion 515*a* and the second convex portion 515*b* depending on the user's preference.

The concave portion 514 is configured to be connected to the second convex portion 515*b*. For example, the concave portion 514 and the second convex portion 515*b* are configured to form a ruffle or wavy shape as a whole. Accordingly, the concave portion 514 and the second convex portion 515*b* are configured to be easily used for the eye makeup.

The concave portion 514 is configured to connect the first convex portion 515*a* to the second convex portion 515*b*. The concave portion 514 and the first convex portion 515*a* are configured to form an apex. The opening 517 is configured to be positioned between the concave portion 514 and the first convex portion 515*a*. The opening 517 is configured to have a shape of a heart. The opening 517 is configured to include a first opening 517*a* and a second opening 517*b*. A shape or size of the first opening 517*a* may be different from a shape or size of the second opening 517*b*.

With reference to FIG. 10(*b*), the geometry portion 510 is configured to include a strap portion 519. The strap portion 519 is configured to have a shape of a strap. A plurality of strap portions 519 can be provided. For example, the strap portion 519 is configured to include a first strap portion 519*a*, a second strap portion 519*b*, and a third strap portion 519*c*. The first strap portion 519*a*, the second strap portion 519*b*, and the third strap portion 519*c* are configured to form a triangular shape as a whole. The strap portion 519 is configured to have a width and an elongated shape. The strap portion 519 is configured to have a constant or changed width along an elongated direction.

The geometry portion 510 is configured to include the opening 517. The opening 517 is configured to be formed by the strap portion 519. For example, the opening 517 is configured to be formed by the first strap portion 519*a*, the second strap portion 519*b*, and the third strap portion 519*c*.

Figure 11A:
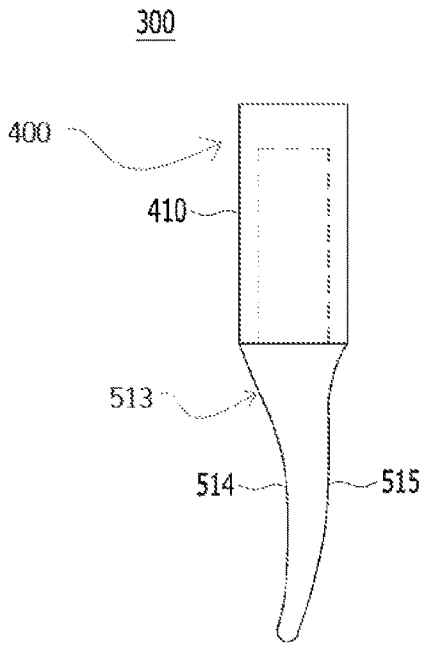
FIGS. 11(*a*) and 11(*b*) are views illustrating the cap unit including a geometry module extended from a second body toward the drawing unit.
Figure 11B:
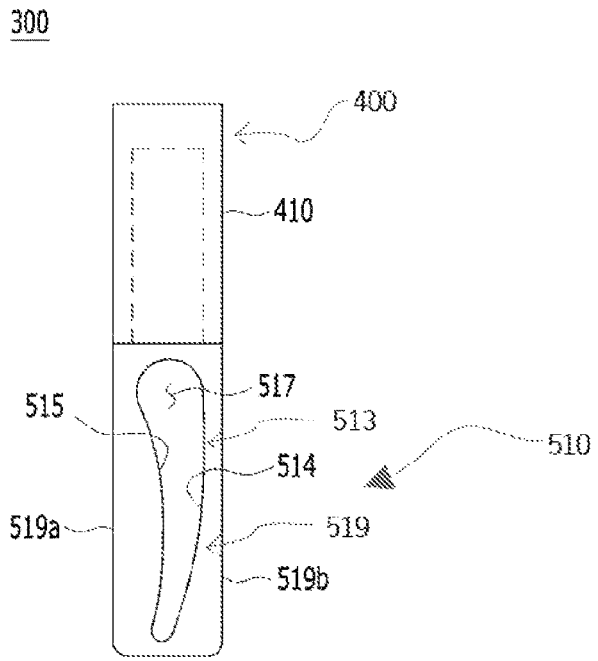

FIGS. 11(*a*) and 11(*b*) are views illustrating the cap unit 300 including the geometry module 500 extended from the second body 400 toward the drawing unit 200 (refer to FIG. 2).

With reference to FIGS. 11(*a*) and 11(*b*), the geometry module 500 is configured to have the shape extended from the second body 400 toward the drawing unit 200 (refer to FIG. 2). When the cap unit 300 is coupled to the drawing unit 200, the geometry module 500 can be overlapped with the drawing unit 200 (refer to FIG. 1). Accordingly, it is possible to increase the space efficiency of the cosmetic applicator 100 (refer to FIG. 1).

With reference to FIG. 11(*a*), the geometry portion 510 is configured to include the concave portion 514 and the convex portion 515. The concave portion 514 and the convex portion 515 are configured to be opposite to each other. Such a shape enables various shape to be formed in the eye makeup.

With reference to FIG. 11(*b*), the geometry portion 510 is configured to include the strap portion 519. The strap portion 519 is configured to include the first strap portion 519*a* and the second strap portion 519*b*. The first strap portion 519*a* and the second strap portion 519*b* are configured to be connected to each other. The first strap portion 519*a* and the second strap portion 519*b* are configured to be elongated from the second body 400 toward the drawing unit 200 (refer to FIG. 1). The first strap portion 519*a* and the second strap portion 519*b* are configured to have widths different from each other in the elongated direction.

The first strap portion 519*a* and the second strap portion 519*b* are configured to form the opening 517. In other words, the opening 517 is configured to be surrounded by the first strap portion 519*a* and the second strap portion 519*b*.

A side of the first strap portion 519*a* can form the convex portion 515. The convex portion 515 is configured to be connected to the opening 517. A side of the second strap portion 519*b* can form the concave portion 514. The concave portion 514 is configured to be connected to the opening 517.

A cosmetic applicator according to an example of this invention may include a geometry member that is configured to guide an eye makeup.

A cosmetic applicator according to another example of this invention may include a second body to which a plurality of geometry portion are selectively coupled.

Effects of this invention are not limited to the above-mentioned effects, and this invention is construed to include every effect that can be derived from a configuration of the inventions described in the detailed description and what is claimed of this invention.

The description above is provided merely as an example, and people having normal knowledge in the art to which this invention belongs can understand that it is possible to easily perform modification to another embodiment without altering the technical idea or essential feature of this invention. Therefore, the embodiments described above need to be understood as exemplified embodiments in every aspect and not as examples limiting this invention. For example, the configurational elements described in singular forms may be realized in a distributed manner. Similarly, the configurational elements described in distributed manner may be realized in a combined manner.

The scope of this invention needs to be construed by the claims below, and meaning and the scope of what is claimed and every modified or altered embodiment derived from an equivalent concept of what is claimed need to be construed to belong to the scope of this invention.

While the present invention has been described with respect to the specific embodiments, it will be apparent to those skilled in the art that various changes and modifications may be made without departing from the spirit and scope of the invention as defined in the following claims.

What is claimed is:

1. A cosmetic applicator, comprising:

a drawing unit including:

a first body having a reservoir configured to contain a cosmetic; and an applicator tip extended from the first body, and configured to apply the cosmetic on a face; and a cap unit detachably coupled to the drawing unit, the cap unit including:

a second body detachably coupled to the drawing unit, wherein the second body comprises an accommodation portion disposed at a first end thereof to accommodate the applicator tip when the cap unit is coupled to the drawing unit; and a geometry module connected to the second body, and configured to guide the applicator tip on the face around an eye, wherein the second body includes a first coupling portion and the geometry module includes a second coupling portion, wherein the second coupling portion of the geometry module is hingedly coupled to the first coupling portion of the second body, and the geometry module is configured to rotate around the first coupling portion, wherein the geometry module comprises first and second geometry portions disposed on opposing sides of the first and second coupling portions, the first geometry portion has a first side edge, a second side edge positioned opposite to the first side edge, and a third side edge connecting an end of the first side edge with an end of the second side edge, wherein a distance between the first side edge and the second side edge continuously increases in a direction from the second coupling portion to the third side edge, wherein the third side edge has a concavity extending inwardly from the end of the second side edge and a convexity extending inwardly from the end of the first side edge such that the convexity and concavity form a continuous curvature along the length of the third side edge, the second geometry portion has a fourth side edge extending from the first side edge, a fifth side edge extending from the second side edge and positioned opposite to the fourth side edge, and a sixth side edge connecting an end of the fourth side edge with an end of the fifth side edge, wherein a distance between the fourth side edge and the fifth side edge continuously decreases in a direction from the second coupling portion to the sixth side edge such that the fourth and fifth side edges converge to form the sixth side edge, the sixth edge being formed as a single convex curvature, and wherein the second coupling portion is positioned substantially at a midpoint of a line extending from the third side edge of the first geometry portion to the sixth side edge of the second geometry portion.

2. The cosmetic applicator according to claim 1, wherein the first geometry portion has a flat surface.

3. The cosmetic applicator according to claim 2, wherein the first geometry portion includes an opening.

4. The cosmetic applicator according to claim 2, wherein the first geometry portion has a thickness, and the thickness of the first geometry portion decreases as it goes toward an edge of the first geometry portion.

5. The cosmetic applicator according to claim 1, wherein the first coupling portion is positioned at a second end end of the second body.

6. The cosmetic applicator according to claim 1, wherein the geometry module is adapted to rotate about the first and second coupling portions between first and second states, wherein in the first state, the first geometry portion is overlapped with the second body and the line extending from the third side edge of the first geometry portion to the sixth side edge of the second geometry portion is aligned with a longitudinal axis extending through the second body and the second geometry portion extends away from a second end of the second body, where the second end of the second body is opposite of the first end of the second body, and wherein in the second state, the second geometry portion is overlapped with the second body and the line extending from the third side edge of the first geometry portion to the sixth side edge of the second geometry portion is aligned with the longitudinal axis extending through the second body and the first geometry portion is configured to extend away from the second end of the second body.

7. The cosmetic applicator according to claim 1, wherein the first coupling portion includes a first stopper disposed on an inner or an outer peripheral surface of the first coupling portion to prohibit a rotation of the second coupling portion, wherein the second coupling portion includes a second stopper disposed on an outer or an inner peripheral surface of the second coupling portion and having a shape corresponding to the first stopper, and wherein the second stopper is configured to be coupled to the first stopper as the geometry module rotates.

8. The cosmetic applicator according to claim 7, wherein the first stopper has a concave shape formed toward the second coupling portion, and wherein the second stopper has a convex shape formed toward the first coupling portion.

9. The cosmetic applicator according to claim 8, wherein the first stopper is provided in plurality, wherein the second stopper is provided in plurality, and wherein the number of the plurality of first stoppers is equal to or greater than the number of the plurality of second stoppers.

10. The cosmetic applicator according to claim 7, wherein the first stopper has a convex shape formed toward the second coupling portion, and wherein the second stopper has a concave shape formed toward the first coupling portion.

11. The cosmetic applicator according to claim 10, wherein the first stopper includes at least one first stopper, wherein the second stopper is provided in plurality, and wherein the number of the at least one first stopper is equal to or smaller than the number of the plurality of second stoppers.

12. The cosmetic applicator according to claim 7, wherein at least one of the first stopper and the second stopper has elasticity.

* * * * *